US005984456A

United States Patent [19]

Bern

[11] Patent Number: 5,984,456

[45] **Date of Patent: *Nov. 16, 1999**

[54] DIRECT PRINTING METHOD UTILIZING DOT DEFLECTION AND A PRINTHEAD STRUCTURE FOR ACCOMPLISHING THE METHOD

[75] Inventor: Bengt Bern, Molndal, Sweden

[73] Assignee: Array Printers AB, Vastra Frolunda, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/759,481

[22] Filed: Dec. 5, 1996

[51] Int. Cl.[6] ..... B41J 2/06

[52] U.S. Cl. ..... 347/55

[58] Field of Search ..... 347/55, 141, 123, 347/151

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |

(List continued on next page.)

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

*Primary Examiner*—John Barlow
*Assistant Examiner*—C. Dickens
*Attorney, Agent, or Firm*—Knobbe, Martens, Olson & Bear, LLP

[57] ABSTRACT

A printhead structure and a method are used in direct electrostatic printing wherein streams of charged toner particles from a source of toner particles are directed onto an image carrier, such as a sheet of paper. A first set of print electrodes surround apertures through which the streams of toner particles flow. Voltages are selectively applied to the print electrodes to control the flow of toner particles through the respective apertures. A set of deflection electrodes are also associated with the apertures. Deflection voltages from at least one deflection voltage source are applied to the deflection electrodes to increase the convergence of the toner particles onto the information carrier and also to control the trajectories of the toner particles onto predetermined dot locations on the information carrier so that each aperture may provide toner particles to multiple lateral locations on the information carrier.

17 Claims, 7 Drawing Sheets

U.S. PATENT DOCUMENTS

| | | | |
|---|---|---|---|
| 3,779,166 | 12/1973 | Pressman et al. . | |
| 3,815,145 | 6/1974 | Tisch et al. | 347/123 |
| 4,263,601 | 4/1981 | Nishimura et al. . | |
| 4,274,100 | 6/1981 | Pond . | |
| 4,353,080 | 10/1982 | Cross . | |
| 4,382,263 | 5/1983 | Fischbeck et al. . | |
| 4,384,296 | 5/1983 | Torpey . | |
| 4,386,358 | 5/1983 | Fischbeck . | |
| 4,470,056 | 9/1984 | Galetto et al. . | |
| 4,478,510 | 10/1984 | Fujii et al. . | |
| 4,491,794 | 1/1985 | Daley et al. . | |
| 4,491,855 | 1/1985 | Fujii et al. . | |
| 4,498,090 | 2/1985 | Honda et al. . | |
| 4,511,907 | 4/1985 | Fukuchi . | |
| 4,525,708 | 6/1985 | Hareng et al. . | |
| 4,525,727 | 6/1985 | Kohashi et al. . | |
| 4,571,601 | 2/1986 | Teshima . | |
| 4,675,703 | 6/1987 | Fotland . | |
| 4,717,926 | 1/1988 | Hotomi . | |
| 4,743,926 | 5/1988 | Schmidlin et al. . | |
| 4,748,453 | 5/1988 | Lin et al. . | |
| 4,814,796 | 3/1989 | Schmidlin . | |
| 4,831,394 | 5/1989 | Ochiai et al. . | |
| 4,837,071 | 6/1989 | Tagoku et al. . | |
| 4,860,036 | 8/1989 | Schmidlin . | |
| 4,903,050 | 2/1990 | Schmidlin . | |
| 4,912,489 | 3/1990 | Schmidlin . | |
| 4,922,242 | 5/1990 | Parker . | |
| 5,028,812 | 7/1991 | Bartky . | |
| 5,036,341 | 7/1991 | Larsson . | |
| 5,038,159 | 8/1991 | Schmidlin et al. . | |
| 5,057,855 | 10/1991 | Damouth . | |
| 5,072,235 | 12/1991 | Slowik et al. . | |
| 5,083,137 | 1/1992 | Badyal et al. . | |
| 5,095,322 | 3/1992 | Fletcher . | |
| 5,121,144 | 6/1992 | Larson et al. . | |
| 5,128,695 | 7/1992 | Maeda . | |
| 5,148,595 | 9/1992 | Doggett et al. . | |
| 5,170,185 | 12/1992 | Takemura et al. . | |
| 5,181,050 | 1/1993 | Bibl et al. . | |
| 5,204,696 | 4/1993 | Schmidlin et al. . | |
| 5,204,697 | 4/1993 | Schmidlin . | |
| 5,214,451 | 5/1993 | Schmidlin et al. . | |
| 5,229,794 | 7/1993 | Honman et al. . | |
| 5,235,354 | 8/1993 | Larson . | |
| 5,237,346 | 8/1993 | Da Costa et al. . | |
| 5,256,246 | 10/1993 | Kitamura . | |
| 5,257,045 | 10/1993 | Bergen et al. . | |
| 5,270,729 | 12/1993 | Stearns . | |
| 5,274,401 | 12/1993 | Doggett et al. . | |
| 5,307,092 | 4/1994 | Larson . | |
| 5,329,307 | 7/1994 | Takemura et al. . | |
| 5,374,949 | 12/1994 | Wada et al. . | |
| 5,386,225 | 1/1995 | Shibata . | |
| 5,402,158 | 3/1995 | Larson . | |
| 5,414,500 | 5/1995 | Furukawa . | |
| 5,446,478 | 8/1995 | Larson . | |
| 5,450,115 | 9/1995 | Bergen et al. . | |
| 5,453,768 | 9/1995 | Schmidlin . | |
| 5,473,352 | 12/1995 | Ishida . | |
| 5,477,246 | 12/1995 | Hirabayashi et al. . | |
| 5,477,250 | 12/1995 | Larson . | |
| 5,506,666 | 4/1996 | Masuda et al. . | |
| 5,508,723 | 4/1996 | Maeda . | |
| 5,515,084 | 5/1996 | Larson . | |
| 5,526,029 | 6/1996 | Larson et al. . | |
| 5,558,969 | 9/1996 | Uyttendaele et al. | 347/55 |
| 5,559,586 | 9/1996 | Wada . | |
| 5,600,355 | 2/1997 | Wada . | |
| 5,614,932 | 3/1997 | Kagayama . | |
| 5,617,129 | 4/1997 | Chizuk, Jr. et al. . | |
| 5,625,392 | 4/1997 | Maeda . | |
| 5,640,185 | 6/1997 | Kagayama . | |
| 5,650,809 | 7/1997 | Kitamura . | |
| 5,666,147 | 9/1997 | Larson . | |
| 5,677,717 | 10/1997 | Ohashi | 347/69 |
| 5,708,464 | 1/1998 | Desie . | |
| 5,774,159 | 6/1998 | Larson . | |
| 5,805,185 | 9/1998 | Kondo . | |
| 5,818,480 | 10/1998 | Bern et al. . | |
| 5,818,490 | 10/1998 | Larson . | |
| 5,847,733 | 12/1998 | Bern . | |
| 5,867,191 | 2/1999 | Luque et al. | 347/55 |

FOREIGN PATENT DOCUMENTS

| | | |
|---|---|---|
| 55-55878 | 4/1980 | Japan . |
| 55-84671 | 6/1980 | Japan . |
| 55-87563 | 7/1980 | Japan . |
| 56-89576 | 7/1981 | Japan . |
| 58-044457 | 3/1983 | Japan . |
| 58-155967 | 9/1983 | Japan . |
| 62-248662 | 10/1987 | Japan . |
| 62-13356 | 11/1987 | Japan . |
| 01120354 | 5/1989 | Japan . |
| 6329795 | 5/1990 | Japan . |
| 05220963 | 8/1990 | Japan . |
| 04189554 | 8/1992 | Japan . |
| 4-268591 | 9/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |
| 9201565 | 2/1992 | WIPO . |

DIRECT PRINTING METHOD UTILIZING DOT DEFLECTION AND A PRINTHEAD STRUCTURE FOR ACCOMPLISHING THE METHOD

BACKGROUND OF THE INVENTION

1. Field of the Invention

The present invention relates to a direct electrostatic printing method, in which a stream of computer generated signals, defining image information, are converted to a pattern of electrostatic fields to selectively control the deposition of charged toner particles in an image configuration directly onto an information carrier.

2. Description of the Related Art

Of the various electrostatic printing techniques, the most familiar and widely utilized is xerography, wherein latent electrostatic images formed on a charge retentive surface, such as a roller, are developed by a toner material to render the images visible, the images being subsequently transferred to plain paper. This process is called an indirect process since the visible image is first formed on an intermediate photoreceptor and then transferred to a paper surface.

Another method of electrostatic printing is one that has come to be known as direct electrostatic printing, DEP. This method differs from the aforementioned xerographic method in that charged toner particles are deposited directly onto an information carrier to form a visible image. In general, this method includes the use of electrostatic fields controlled by addressable electrodes for allowing passage of toner particles through selected apertures in a printhead structure. A separate electrostatic field is provided to attract the toner particles to an image receiving substrate in an image configuration.

The novel feature of direct electrostatic printing is its simplicity of simultaneous field imaging and toner transport to produce a visible image on the substrate directly from computer generated signals, without the need for those signals to be intermediately converted to another form of energy such as light energy, as is required in electrophotographic printers, e.g., laser printers.

U.S. Pat. No. 5,036,341 granted to Larson, discloses a direct printing method which begins with a stream of electronic signals defining the image information. A uniform electric field is created between a high potential on a back electrode and a low potential on a toner carrier. That uniform field is modified by potentials on selectable wires in a two dimensional wire mesh array placed in the print zone. The wire mesh array consists of parallel control wires, each of which is connected to an individual voltage source, across the width of the information carrier. A drawback of such a device is that, during operation of the wire mesh array, the individual wires can be sensitive to the potentials applied on adjacent wires, resulting in undesired printing due to interaction or cross-talk between neighboring wires.

U.S. Pat. No. 5,121,144, also granted to Larson, discloses a control electrode array formed of a thin sheet-like element comprising a plurality of addressable control electrodes and corresponding voltage sources connected thereto. The control electrode array may be constructed of a flexible, electrically insulating material and overlaid with a printed circuit such that apertures in the material are arranged in rows and columns and are surrounded by electrodes. An electrostatic field on the back of electrode attracts toner particles from the surface of the particle carrier to create a particle stream toward the back electrode. The particle stream is modulated by voltage sources which apply an electric potential to selected control electrodes to produce electrostatic fields which permit or restrict transport of toner particles from the particle carrier through the corresponding apertures. The modulated streams of charged particles allowed to pass through the selected apertures impinge upon an information carrier interposed in the particle stream to provide line-by-line scan printing to thereby form a visible image.

The control electrodes are aligned in several transverse rows extending perpendicularly to the motion of the information carrier. All control electrodes are initially at a white potential $V_w$ to prevent all particle transport from the particle carrier. As image locations on the information carrier pass beneath apertures, corresponding control electrodes are set to a black potential $V_b$ to produce an electrostatic field which draws the toner particles from the toner carrier. Charged toner particles allowed to pass through the apertures are subsequently deposited on the information carrier in the configuration of the desired image pattern. The toner particle image is then made permanent by using heat and pressure to fuse the toner particles on the surface of the information carrier.

Common to all electrostatic printing methods is that toner particles are transported along a substantially straight trajectory coinciding with a central axis of the aperture, and impinge upon the information carrier at a substantially right angle, resulting in that the addressable area of each aperture is limited to a single "dot," having a predetermined, non-variable extension on the information carrier. The number of dots which can be printed per length unit in a longitudinal direction, i.e., parallel to the motion of the information carrier, can be increased by lowering the speed of the information carrier through the print zone, thereby allowing a larger number of print sequences per length unit to be performed.

A drawback of the aforementioned method is that the number of dots which can be printed per length unit in a transverse direction, i.e., perpendicular to the motion of the information carrier, is strictly limited by the number of apertures that can be arranged in the control array.

Hitherto, the transverse print addressability has generally been improved by increasing the number of apertures and related control electrodes across the control array, resulting in higher manufacturing cost and more complicated control function. However, increasing the number of apertures results in the apertures having to be spaced closer to each other, thereby causing the control electrodes to not only act on their associated aperture but also to substantially influence all adjacent apertures, due to the interaction between adjacent electrostatic fields. This results in a degradation of the print quality and readability.

Further, to increase transverse print resolution, i.e., the number of distinguishable dots that can be printed per length unit in a transverse direction across the information carrier, it is also essential to provide dots that are sufficiently small to be deposited adjacent to each other without overlapping by than half a dot width. For instance, to obtain a print resolution of 600 dots per inch (DPI), the overlap width of two adjacent dots might not exceed 1/600 inch, i.e., about 42 microns, and the size of a dot might be in the order of 60 to 80 microns to be discernible on the image configuration.

Hitherto, dot size has been decreased by reducing the amplitude or the pulse width of the electrostatic field controlling the corresponding aperture in order to reduce the amount of toner particles passing through the aperture.

However, this may not only influence the size of the dots, but may even considerably affect their density and uniformity.

Therefore, regardless of the design of the control electrode array, the present applicant has perceived a need to improve the print resolution of direct printing methods by enhancing transverse print addressability while reducing the dot size, without increasing the number of apertures required.

SUMMARY OF THE INVENTION

The present invention satisfies a need for higher quality direct printing methods, having improved transverse print addressability, improved dot size control and thus higher print resolution.

A first object of the present invention is to provide an improved printhead structure which allows increased print addressability without increasing the number of apertures and associated print electrodes and print voltage sources. For example, a transverse print addressability of 600 DPI is achieved in accordance with the present invention utilizing a printhead structure having 200 apertures per inch in a transverse direction.

Another object of the present invention is to provide an improved printhead for printing dots which are sufficiently small to be distinguishable at higher print resolution. For example, a dot size in the range 60 to 80 microns is obtained in accordance with the present invention utilizing apertures with a diameter in the order of 120 to 150 microns.

Those objects are achieved in accordance with the present invention in that the particle stream from a particle source through any selected aperture of the printhead structure is modulated in several consecutive print steps by a control signal and deflection signals. The control signal is supplied to a print electrode surrounding aperture to produce an electrostatic field which, responsive to control in accordance with the image information, selectively permits or restricts the particle stream through the aperture. The deflection signals are supplied to deflection electrodes to influence the convergence and the transport trajectory of the toner particle stream. An amplitude difference between deflection signals modifies the symmetry of the electrostatic field configuration, thereby deflecting the transport trajectory of the toner particle stream toward a predetermined dot location on the information carrier. The deflection signals are dimensioned to apply converging forces on the toner particle stream in order to focus the toner transport onto the predetermined dot location. Accordingly, several dot locations can be addressed through the same aperture during each print sequence by sequentially influencing the symmetry and convergence of the electrostatic field configuration through the aperture, thereby modifying the position and reducing the size of each printed dot.

A printhead structure in accordance with a preferred embodiment of the invention, comprises two sets of deflection electrodes and at least one deflection voltage source connected to each set of deflection electrodes. A potential difference is produced between a first deflection signal D1 on a first set of deflection electrodes and a second deflection signal D2 on a second set of deflection electrodes. The amplitudes of D1 and D2 are chosen to influence the convergence of the toner particle stream toward the information carrier, while the difference between D1 and D2 is chosen to influence the transport trajectory of the toner particle stream toward the information carrier.

The above and other objects, features and advantages of the present invention will become more apparent from the following description when read in conjunction with the accompanying drawings in which preferred embodiments of the invention are shown by way of illustrative examples.

BRIEF DESCRIPTION OF THE DRAWINGS

FIG. 6 is section view of the printhead structure across the section line I—I of FIG. 5.

DETAILED DESCRIPTION OF THE PREFERRED EMBODIMENT

Figure 1:
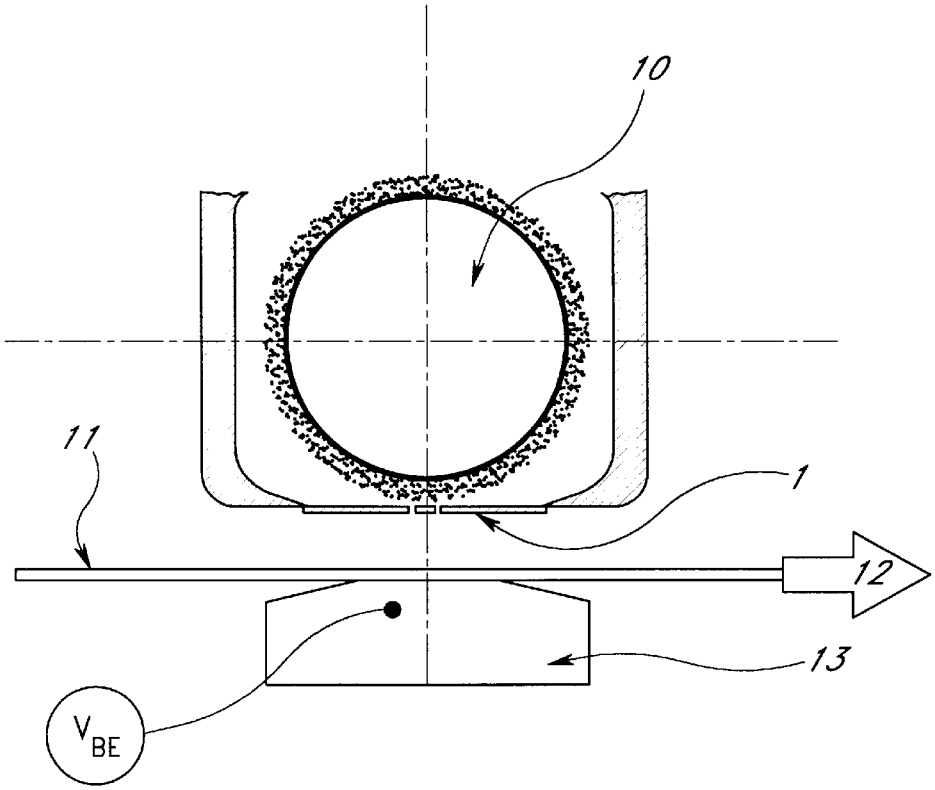
FIG. 1 is a schematic section view across a print zone in an image recording device in which a printhead structure in accordance with the present invention is utilized to control a particle stream from a particle source to an information carrier.
Figure 2:
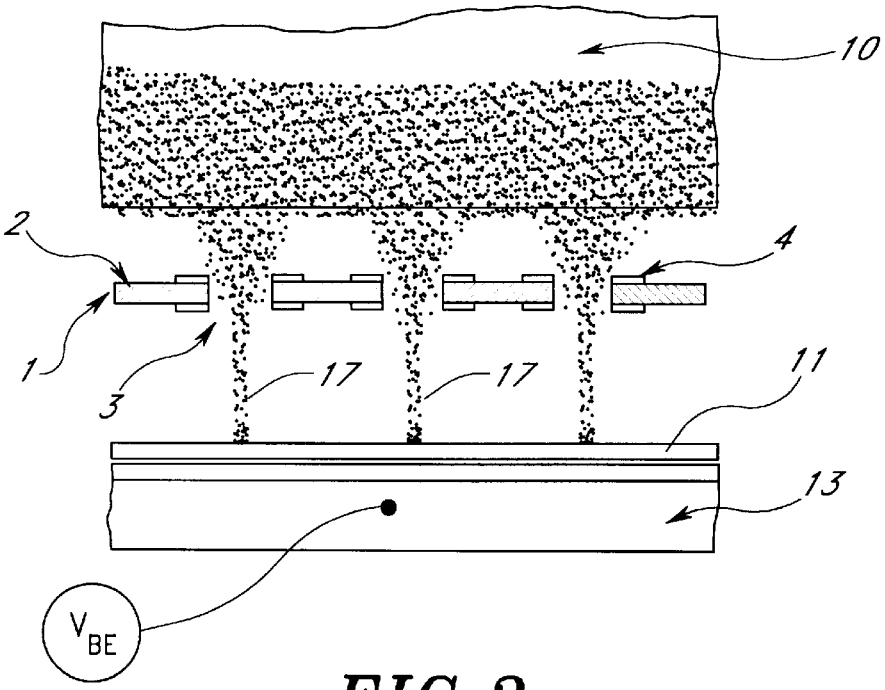
FIG. 2 is an enlarged partial front view of the print zone.

A print zone in an image recording device, as schematically illustrated in FIGS. 1 and 2, consists of an electric field generated between a particle source 10 and a back electrode 13 to transport charged toner particles 17 therebetween; a printhead structure 1 positioned in the electric field to modulate the transport of charged toner particles 17; and an information carrier 11 onto which the transported particles 17 are deposited in an image configuration.

Image recording devices include generally several print zones each of which corresponds to a specific color of the toner particles 17. The information carrier 11 is then fed in a single path consecutively through the different print zones whereas dots of different colors are superposed on the information carrier 11 to form colored image configurations.

According to a preferred embodiment of the invention, a printhead structure 1 is preferably positioned between a particle source 10, such as a rotating cylindrical sleeve or any other device suitable for toner delivery, and an information carrier 11, such as a sheet of plain, untreated paper or any other medium suitable for direct printing, is caused to move through the print zone at a predetermined, constant feed velocity $v_p$ (arrow 12).

Figure 3:
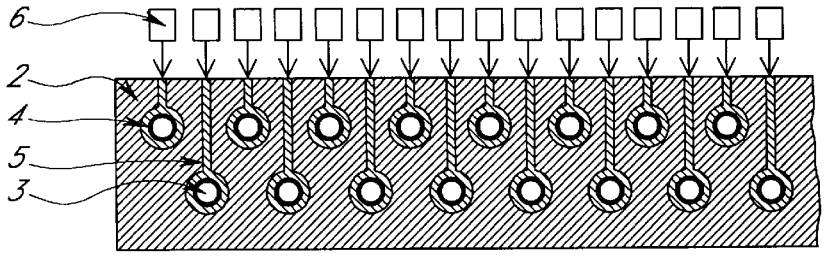
FIG. 3 is a partial plane view of the top surface of a printhead structure according to a preferred embodiment of the invention.
Figure 4:
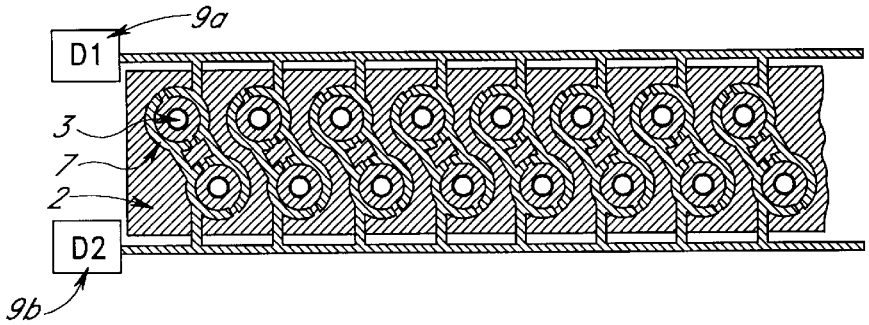
FIG. 4 is a partial plane view of the bottom surface of a printhead structure according to a preferred embodiment of the invention.

As it is more apparent from FIG. 3 and FIG. 4, the printhead structure 1 includes an electrically insulating substrate layer 2 preferably formed of a non-rigid, flexible material, such as polyimide, or the like, having dielectric properties and sufficient flexibility. The substrate layer 2 has a top surface (FIG. 3) facing the particle source 10, a bottom surface (FIG. 4) facing the information carrier 11 and a plurality of apertures 3 arranged through the substrate layer 2 to enable toner transport from the particle source 10 toward the information carrier 11. Note that in FIG. 2 and in FIG. 7, the top surface of the substrate layer 2 is viewed looking through the substrate layer 2 toward the particle source 10 so that the apertures 3 are aligned in the figures. It should be understood that when the substrate layer 2 is viewed facing the top surface, the locations of the apertures 3 will be mirrored about a horizontal center line. A first printed circuit is arranged on the top surface of the substrate layer 2 and comprises a plurality of print electrodes 4 each of which is disposed in relation to a corresponding aperture 3 in the substrate layer 2. Variable voltage sources 6 are connected through a conducting part 5 to the print electrodes 4 to supply control signals $V_{print}$ in accordance with the image information. A second printed circuit is arranged on the bottom surface of the substrate layer 2 and comprises at least one set of deflection electrodes 7. At last one deflection voltage source 9*a* and 9*b* is connected to each set of deflection electrodes 7 to supply deflection signals D1 and D2 in predetermined sequences.

Although a printhead structure can take on various design without departing from the scope of the present invention, a preferred embodiment will be described hereinafter with reference to FIGS. 3, 4, 5, and 6.

The apertures 3 are preferably aligned in parallel rows 8 and columns, the parallel rows 8 extending transversely across the width of the print zone, preferably at a right angle to the feed motion 12 of the information carrier 11, and the columns being aligned at an appropriate angle to the feed motion 12 of the information carrier 11 to ensure complete coverage of the information carrier by providing an addressable area at every point across a line in a direction transverse to the feed motion 12 of the information carrier 11.

Figure 5:
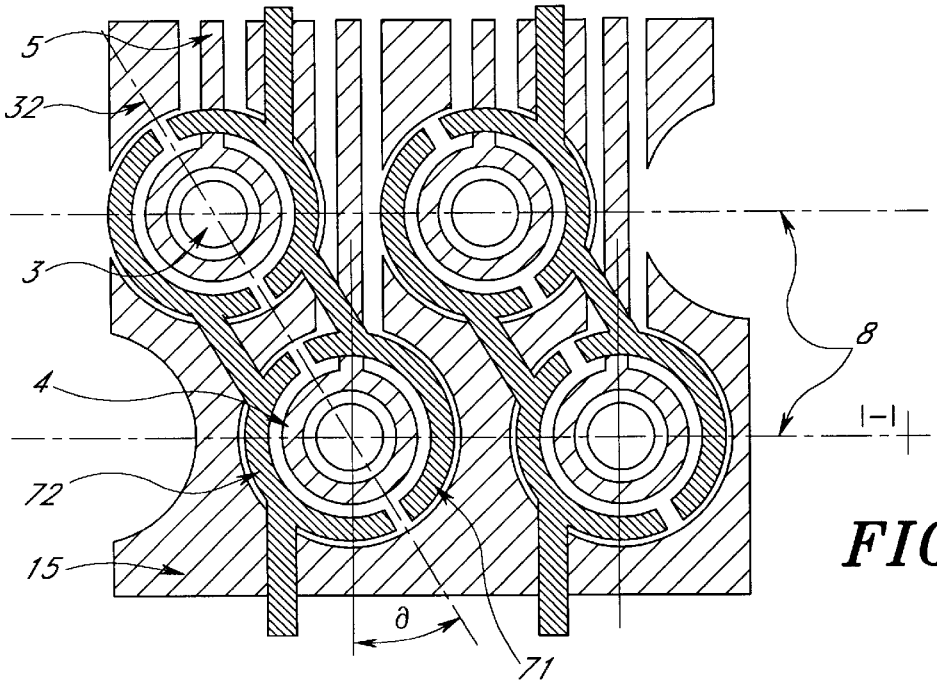
FIG. 5 is an enlargement of the printhead structure showing four apertures and their associated print electrodes and deflection electrodes in superposition.
Figure 6:
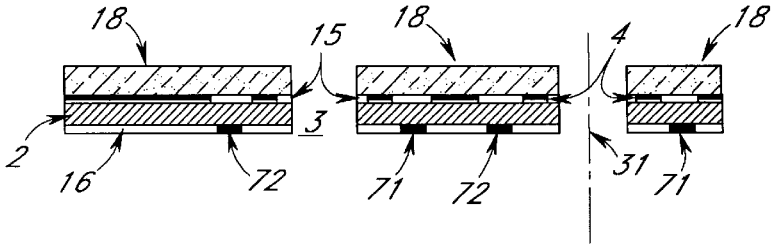
FIG. 6 is a section view of the printhead structure across the section line I—I of FIG. 5.

As is more apparent from FIG. 5 and FIG. 6, the apertures 3 have preferably a circular section with a central axis 31 extending perpendicularly to the substrate layer 2. Each print electrode 4 comprises a preferably ring-shaped part surrounding the periphery of its corresponding aperture 3, with a symmetry axis coinciding with the central axis 31 of the aperture 3 and an inner diameter which is equal to or sensibly larger than the aperture diameter.

Each aperture 3 is related to a first and a second deflection electrode 71 and 72 spaced around a first and second segment of the circumference of the aperture 3, respectively. The deflection electrodes 71 and 72 are preferably semicircular or crescent-shaped and disposed symmetrically on each side of a deflection axis 32 extending diametrically across the circular aperture 3 at a predetermined deflection angle $\partial$ to the feed motion 12 of the information carrier, such that the deflection electrodes 71 and 72 substantially border on a first half and a second half of the circumference of their corresponding aperture 3, respectively.

All first and second deflection electrodes 71 and 72 are connected to a first deflection voltage source 9*a* and a second deflection voltage source 9*b*, respectively. The deflection voltage sources 9*a* and 9*b* supply deflection signals D1 and D2 to the first set and the second set of deflection electrodes 71 and 72 respectively, such that each aperture is exposed to a superposition of D1 and D2.

Each pair of deflection electrodes 71 and 72 is disposed symmetrically about the central axis 31 of its corresponding aperture 3 such that the electric field configuration remains substantially symmetric about the central axis 31 of the aperture 3 when D1 and D2 have the same amplitude.

As illustrated in FIG. 5 and 6, the printhead structure 1 further includes at least one guard layer 15, preferably arranged on the top surface of the substrate layer 2 as a part of the first printed circuit. The guard layer 15 extends between the print electrodes 4 and is set on a guard potential which electrically shields the print electrodes 4 from each other thereby preventing interaction between adjacent control fields. As apparent from FIG. 6, the printhead structure is preferably embedded within a thin protective layer of electrically insulating material such as parylene or the like, arranged on both printed circuits to at least partially cover both surfaces of the substrate layer and the inner wall of each aperture. The protective layer significantly reduces the interaction between the fields generated within an aperture by the corresponding print electrode and deflection electrodes.

The second circuit further includes a layer of semiconductive material 18 such as silicon oxide, silicon dioxide, or the like, arranged by sputtering or by any other suitable method on the protective layer to remove eventual charge accumulation due to undesired toner agglomeration in the vicinity of the apertures.

The present invention also relates to a printing method performed by means of the aforementioned printhead structure.

A substantially uniform electric field is produced between a background potential $V_{BE}$ on the back electrode 13 and a potential (preferably 0 V) on the particle source 10 to apply attractive electric forces on charged toner particles located on the particle source 10.

As image locations on the information carrier 11 pass beneath a row 8 of apertures 3, print sequences are performed to influence the attractive electric forces in order to modulate the stream of toner particles 17 in accordance with the image information.

Each print sequence includes several steps during each of which the particle stream through any selected aperture is controlled by the corresponding print electrode and deflection electrodes.

During each step, a control signal $V_{print}$ is supplied to each print electrode 4 to produce an electrostatic field about the corresponding aperture.

The control signal $V_{print}$ has an amplitude chosen to be above or below a predetermined threshold value to respectively permit or restrict the transport of toner particles from the particle source through the actual aperture. The amplitude may have any level between a white potential $V_w$ preventing all toner transport, and a black potential $V_b$ corresponding to full density dot. The control signal $V_{print}$ has a pulse width chosen as a function of the amount of toner particles intended to pass through the aperture. The pulse width may have any value between 0 and $t_b$.

Every control signal pulse $V_{print}$ is followed by a period $t_w$ during which new toner particles are supplied to the particle source.

During each step, a deflection signal D1 is supplied to a first set of deflection electrodes 71 and a deflection signal D2 is supplied to a second set of deflection electrodes 72, which produces an electric potential difference between both sets of deflection electrodes. That potential difference may have any value within a range −D to D, where −D corresponds to maximal deflection in the opposite direction. Every level of the potential difference corresponds to a specific transport trajectory of the toner particles.

The deflection signals D1 and D2 apply repelling forces on toner particles causing the particle stream to converge toward a predetermined transport trajectory. Due to the symmetrical disposition of the deflection electrodes 71 and 72 about the central axis 31 of their corresponding aperture 3, the field configuration remains substantially symmetrical as long as D1=D2.

During each step, the deflection signals D1 and D2 produce a deflection field which applies converging forces on the particle stream. Those converging forces focus the stream upon a predetermined dot location. The dot location coincides with the central axis 31 of the aperture 3 only when D1=D2. Deflected dots are obtained by producing an inequality D1≠D2, thereby modifying the symmetry of the field configuration.

Figure 7:
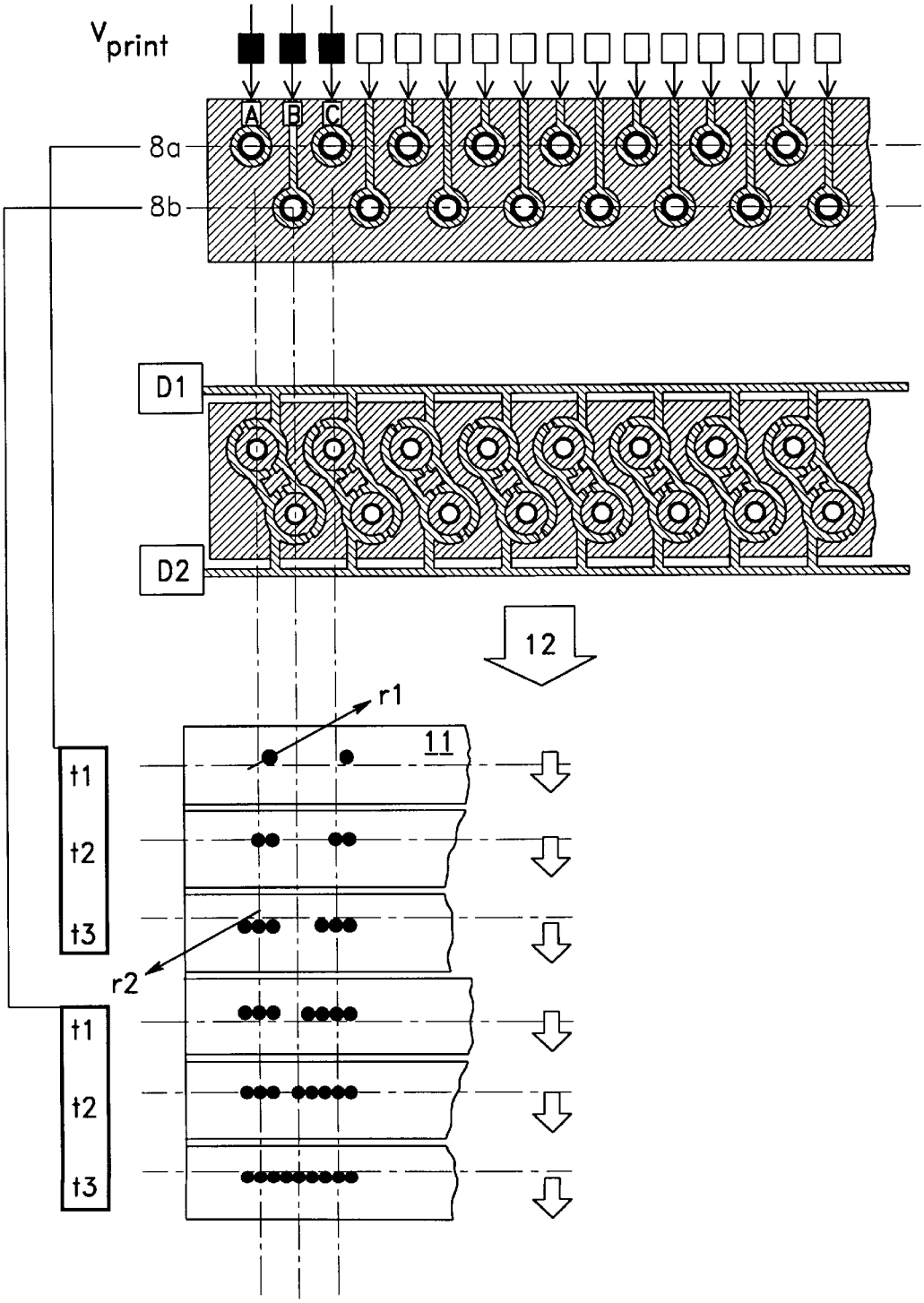
FIG. 7 illustrates a printing method in accordance with the present invention, in which a transverse line, formed of nine dots is printed through three adjacent apertures.

For instance, as illustrated in FIG. 7, nine dots are printed in a continuous transverse line using apertures A, B, C. A print sequence comprises three consecutive steps t1, t2, t3. During a first step t1, the symmetry of the electrostatic field is modified to deflect the particle stream from its initial trajectory in a first direction, while the convergence of the electrostatic field is increased in that direction r1 to focus the particle stream upon a first dot location. During a second step t2, the symmetry of the electrostatic field remains unaltered while its convergence is increased toward a central axis 31 of the aperture 3 to focus the particle stream upon a second, central dot location. During a third step t3, the symmetry of the electrostatic field is modified to deflect the particle stream from its initial trajectory in a direction r2 opposite to r1, while the convergence of the electrostatic field is increased about r2 to focus the particle stream upon a third dot location.

Accordingly, three focused dots can be printed through each single aperture during each print sequence. For instance, by modulating the deflection signals to obtain appropriate convergence and symmetry variations of the field configuration during the consecutive steps, the dot size and the dot deflection can be adjusted to meet the requirement of a 600 DPI print resolution utilizing 200 apertures per inch.

As shown in FIG. 7, a first print sequence is performed as the dot locations pass beneath the first row 8*a* of apertures, whereas dots are printed through apertures A and C, and a second print sequence is performed similarly as the dot locations reach the second row 8*b* of apertures, whereas dots are printed through aperture B.

Figure 8A:
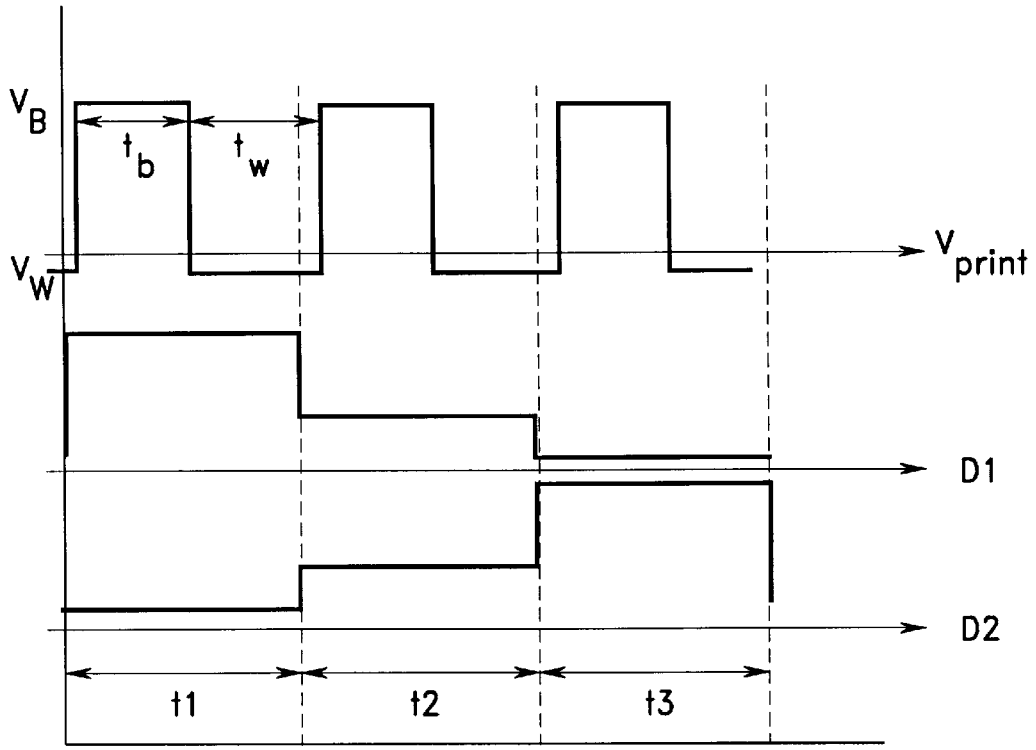
FIGS. 8*a* and 8*b*, illustrate examples of control functions during a print sequence including three consecutive steps, whereas three dots are printed through a single aperture.

FIG. 8*a* is a diagram showing the control signal $V_{print}$ and the deflection signals D1 and D2 as a function of time during a print sequence T wherein three transverse dots are printed.

Figure 8B:
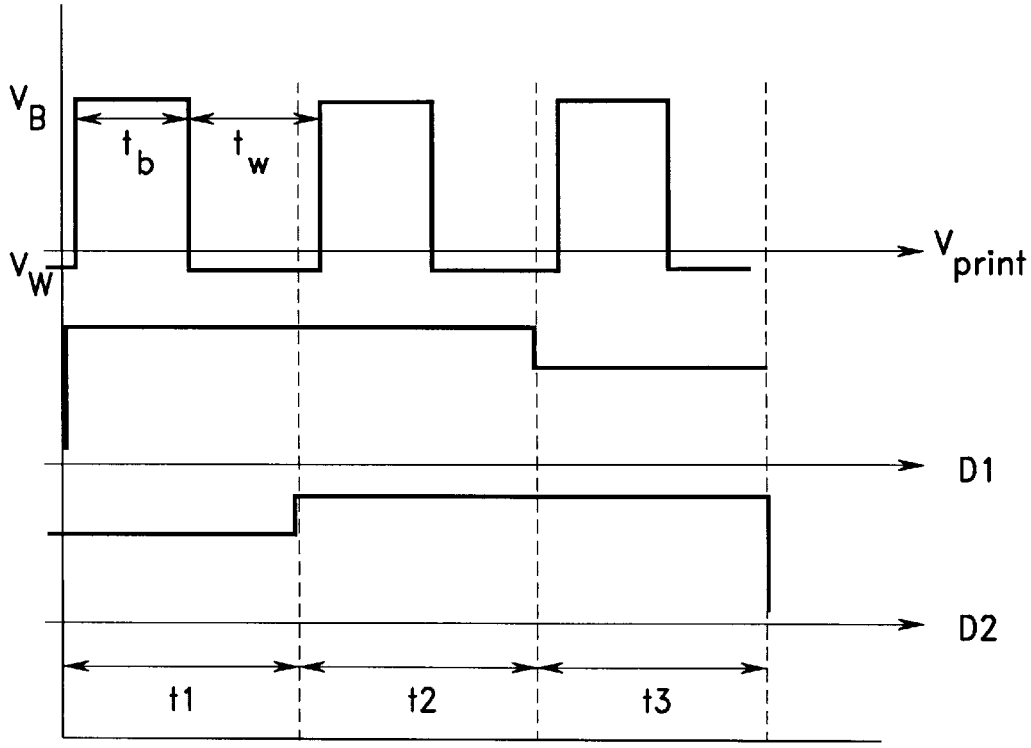

FIG. 8*b* is a diagram showing another example of a control function with the control signal $V_{print}$ and the deflection signals D1 and D2 as a function of time during a print sequence T wherein three transverse dots are printed.

During a first step t1, the deflection signals D1 and D2 are dimensioned to deflect the dots in a first predetermined direction r1 obliquely against the feed motion 12 of the information carrier 11.

During a second step t2, the deflection signals D1 and D2 have the same level, whereby the dots remains undeflected.

During a third step t3, the relation between D1 and D2 is reversed to obtain deflection in a direction r2 opposite to r1.

Each step is characterized by a predetermined relation between both deflection signals D1 and D2. In the examples shown in FIGS. 8*a* and 8*b*, the deflection voltage sources are activated such that D1>D2 during t1, D1=D2 during t2, and D1<D2 during t3.

Figure 9A:
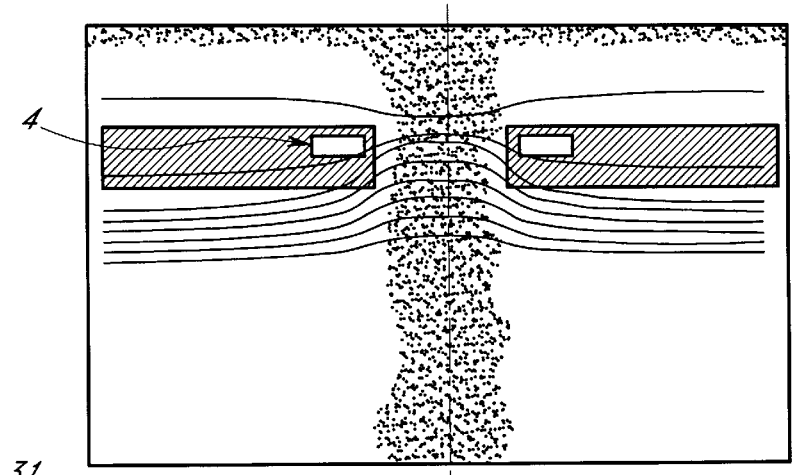
FIG. 9A (PRIOR ART)
FIG. 9*a* illustrates a section view of an aperture in a printhead structure according to prior art and the associated field configuration.

FIG. 9*a* shows a printhead structure according to prior art, in which the toner particle stream is controlled only by a print electrode 4. The equipotential lines illustrate the field configuration. The field configuration is substantially symmetrical about the central axis 31 of the aperture 3 and the toner particle stream is not exposed to any convergence forces, which results in scattering and unfocused dots.

Figure 9B:
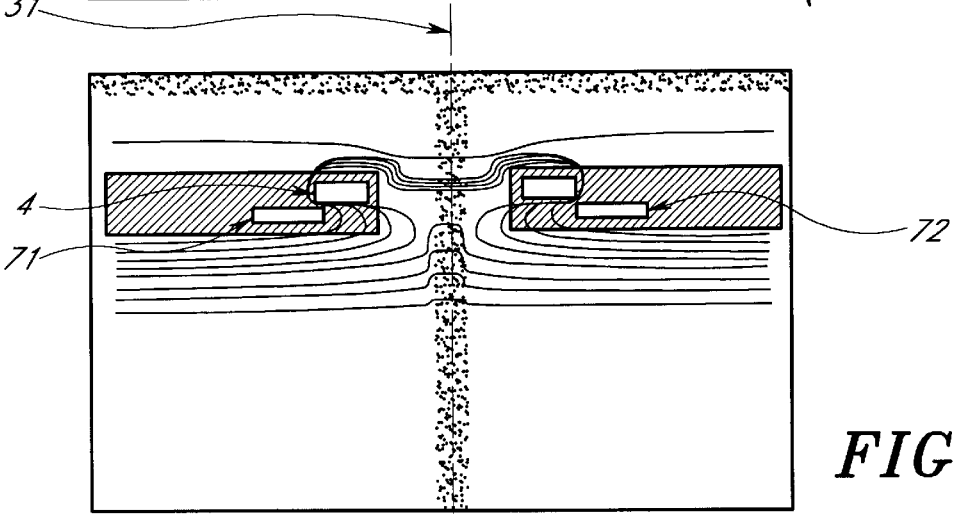
FIG. 9*b* illustrates a section view of an aperture in a printhead structure according to the present invention and the associated convergence field.

As a comparison, FIG. 9*b* shows a printhead structure according to the present invention, which the toner particle stream is controlled by a print electrode 4 and deflection electrodes 71 and 72 are set on the same potential (D1=D2). The field configuration preserves its symmetry and a convergence field is generated by the deflection electrodes 71 and 72 to focus the toner particle stream toward a central axis 31 of the aperture 3, resulting in a focused, undeflected dot.

Figure 9C:
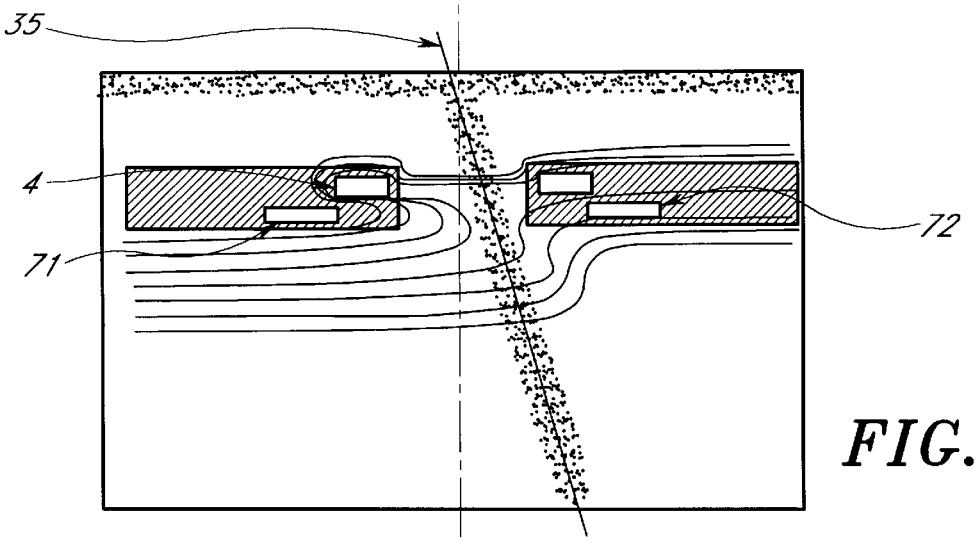
FIG. 9*c* illustrates a section view of an aperture in a printhead structure according to the present invention and the associated convergence and deflection field.

FIG. 9*c* shows a printhead structure according to the present invention, in which the toner particle stream is controlled by a print electrode 4 and deflection electrodes 71 and 72 are set on different potentials (D1≠D2). In that case, the toner particle stream is exposed to both a convergence field and a deflection field. The deflection field determines the transport trajectory 35 of the toner particle stream and the convergence field focus the stream toward the so determined transport trajectory 35.

According to the aforementioned method, a print resolution of 600 DPI is easily obtained by performing three-step sequences on a 200 DPI printhead structure. A 200 DPI printhead structure comprises preferably two parallel rows comprising 100 aperture per inch, which implies that the distance between the central axis of two adjacent apertures of a row is 0.01 inch. Dots in a range 60 to 80 microns are obtained using apertures having generally a diameter in the order of 120 to 150 microns. In that case, the deflection length, i.e., the displacement of a deflected dot with respect to the central axis of the corresponding aperture, is preferably 1/600 inch or about 42 microns.

The deflection angle $\partial$ is chosen to compensate the motion of the information carrier during a step, in order to provide transversely aligned dots. Thus, the deflection angle is dependent on the number of steps performed during a print sequence. The deflection angle is defined by the relation $\tan \partial = 1/N$, where N is the number of steps performed during a print sequence. For three-step sequences, as described above, the deflection angle is thus preferably chosen to be about 18.4°, while the deflection angle is about 26.5° when only two steps are performed. However, the present invention is neither limited to a specific number of steps nor a particular design of the deflection electrodes, the aforementioned embodiments being given only as illustrative examples.

Figure 10:
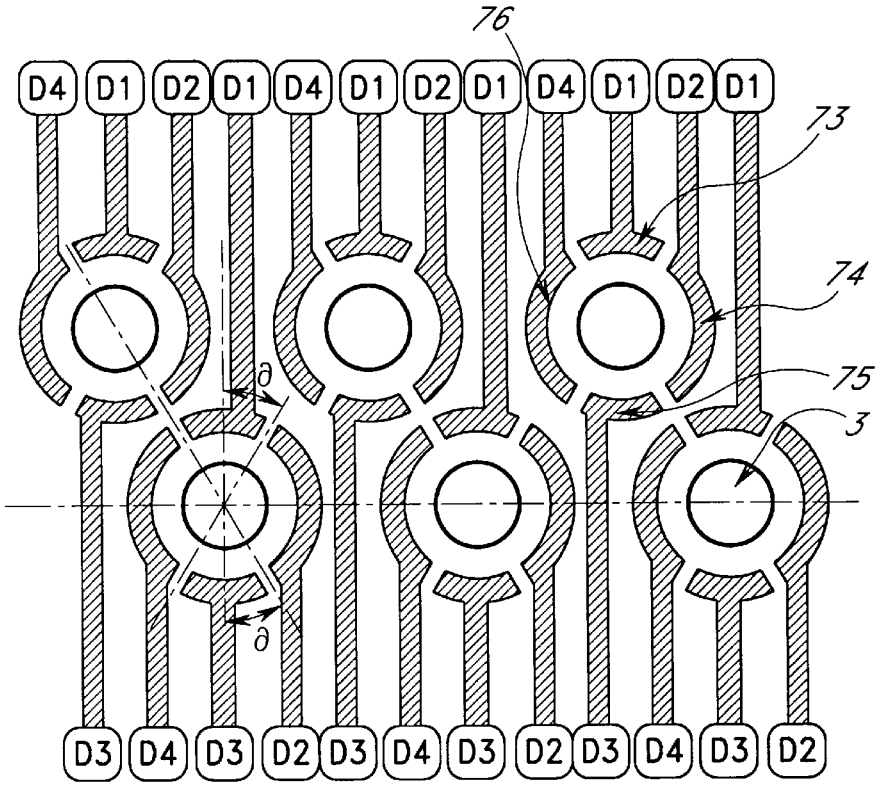
FIG. 10 is an enlargement of an alternative embodiment of the printhead structure showing six apertures and their associated print electrodes and deflection electrodes in superposition, wherein four deflection electrodes are provided for each aperture.
Figure 11:
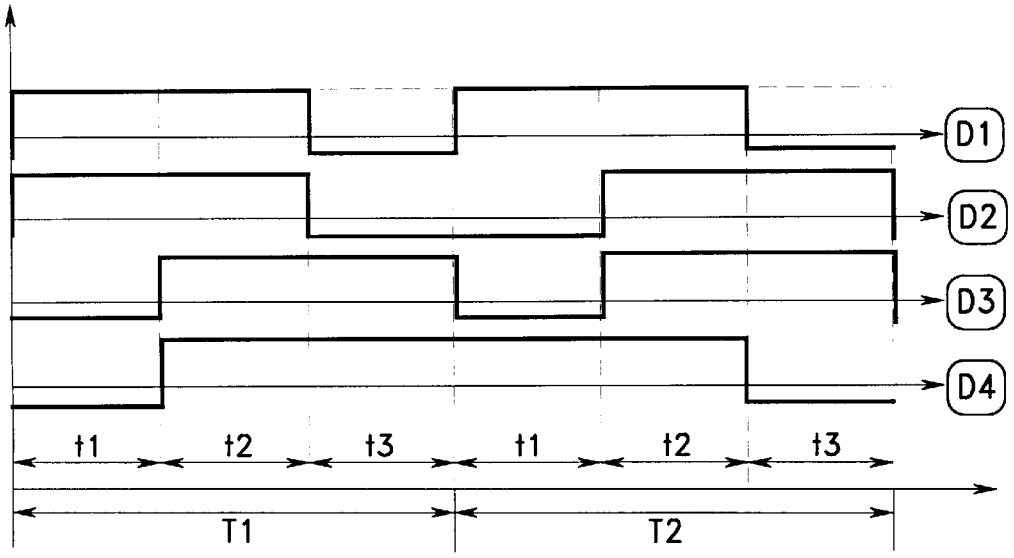
FIG. 11 illustrates the control functions during a print sequence for the embodiment of FIG. 10 wherein alternate print sequences are performed in reverse order.

The present invention is not either limited to two different sets of deflection electrodes. In some applications, it may be convenient to utilize more than two deflection electrodes around the apertures. For instance, it has been observed that the deflection field can be made more uniform by reversing every second print sequence, to alternate both deflection directions r1, r2. Instead of providing three transversely aligned dots in identical series (r1, center, r2) as described above, the series can be reversed to obtain r1, center, r2–r2, center, r1. Hereby, the deflection field has not to be shifted between two opposite directions, resulting in constant, uniform step transitions. Such an embodiment is illustrated in FIG. 10. A printhead structure is provided with four deflection electrodes 73, 74, 75, 76, spaced around each aperture 3 such that each deflection electrode borders on a segment of the periphery of the aperture 3. All similarly located deflection electrodes are connected to a corresponding deflection signal (D1, D2, D3, D4). The deflection field is produced between two symmetrically disposed pairs of deflection electrodes. FIG. 11 shows a control function with D1, D2, D3, D4 as a function of time during consecutive print sequences. For instance, every second print sequence is performed with three steps in the following order:

$$D1=D2>D3=D4 \text{ during } t1$$

$$D1=D2=D3=D4 \text{ during } t2,$$

and $$D1=D2<D3=D4 \text{ during } t3$$

and the remaining print sequences are performed in a reversed order:

$$D1=D4>D2=D3 \text{ during } t1$$

$$D1=D2=D3=D4 \text{ during } t2,$$

and $$D1=D4<D2=D3 \text{ during } t3.$$

Figure 12:
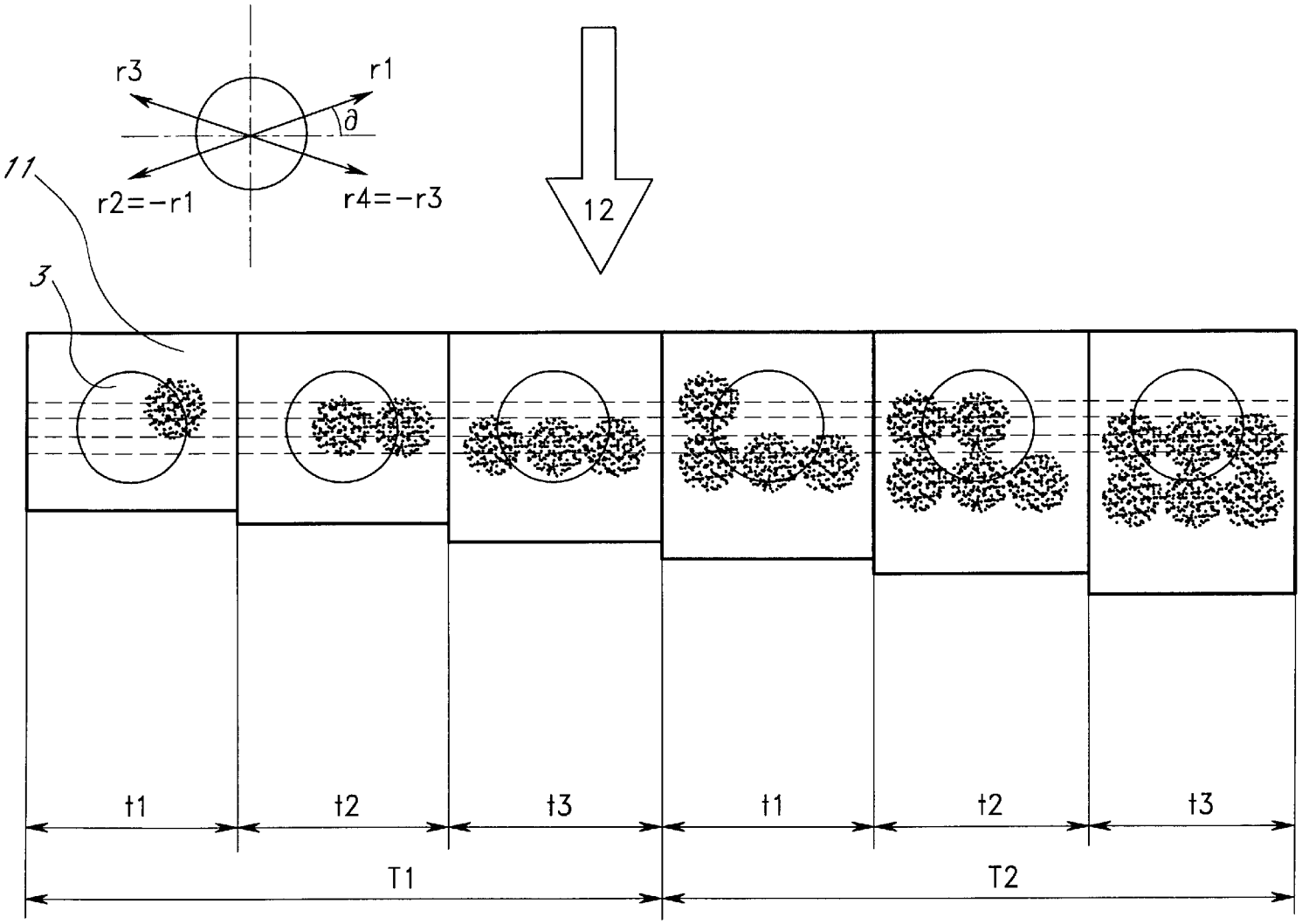
FIG. 12 illustrates the dot locations addressed during two consecutive print sequences by the embodiment of FIG. 10 when controlled by the control functions illustrated in FIG. 11.

Accordingly, the dot locations addressed during two consecutive print sequences are alternated as illustrated in FIG. 12, in a series [r1, center, r2, r3, center, r4], where r2=–r1; r4=–r3; r1 and r3 are reserved with respect to the direction 12 of the motion of the information carrier 11.

From the foregoing it will be recognized that numerous variations and modifications may be effected without departing from the scope of the invention as defined in the appended claims.

What is claimed is:

1. A printhead structure for controlling the stream of charged toner particles from a particle source to an information carrier, comprising:

a substrate layer of electrically insulating material having a top surface facing the particle source and a bottom surface facing the information carrier;

a plurality of apertures arranged through the substrate layer;

a first printed circuit arranged on said top surface of the substrate layer, said first printed circuit including a plurality of print electrodes, each of said print electrodes at least partially surrounding a corresponding aperture;

a second printed circuit arranged on said bottom surface of the substrate layer, said second printed circuit including at least a respective first deflection electrode and a respective second deflection electrode proximate to each aperture, said respective first deflection electrode and said respective second deflection electrode positioned symmetrically with respect to each aperture;

a plurality of print voltage sources, each of said print voltage sources supplying signal pulses to a corresponding print electrode to selectively permit or restrict the stream of charged toner particles through the corresponding aperture; and at least one deflection voltage source connected to each set of deflection electrodes, said at least one deflection voltage source providing deflection voltages to said at least two sets of deflection electrodes to converge the toner particle stream and to control a transport trajectory of the toner particle stream to define a print sequence in which the toner particle stream is directed toward a plurality of predetermined dot locations on the information carrier.

2. A direct electrostatic printing method in which charged toner particles are transported from a particle source through a printhead structure deposited in an image configuration on an information carrier, comprising the steps of:

producing a background electric field between a particle source and a back electrode of the printhead structure;

producing a pattern of electrostatic fields which, responsive to control in accordance with an image information, influence said background electric field to selectively permit or restrict streams of toner particles through apertures in the printhead structure;

supplying a first deflection voltage to a first set of deflection electrodes positioned proximate said apertures and supplying a second deflection voltage to a second set of deflection electrodes positioned proximate said apertures, said first and second sets of deflection electrodes being positioned symmetrically with respect to said apertures, said first deflection voltage and said second deflection voltage having respective amplitudes; and varying an amplitude of at least one of said first and second deflection voltages to define a print sequence, said print sequence producing a pattern of deflection fields, in which the amplitudes of the first and second deflection voltages influence a convergence of the toner particle stream toward the information carrier and the difference between the first and second deflection voltages influence a transport trajectory of the toner particle stream toward the information carrier, thereby simultaneously controlling the size and location of the printed dots.

3. The printhead structure are defined in claim 1, in which the substrate layer is made of a non-rigid, flexible material.

4. The printhead structure are defined in claim 1, in which the plurality of apertures are aligned in at least two parallel rows.

5. The printhead structure as defined in claim 1, in which the first printed circuit comprises a plurality of conductor parts joining said print electrodes to said plurality of print voltage sources.

6. The printhead structure as defined in claim 1, in which said respective first deflection electrode proximate to said each aperture includes a first section disposed adjacent to a first segment of a periphery of said each aperture, and said respective second deflection electrode proximate to said each aperture includes a second section disposed adjacent to a second segment of the periphery of said each aperture.

7. The printhead structure as defined in claim 1, in which each of said apertures has a substantially circular section having a central axis extending through the substrate layer, the periphery of each of said apertures being at least partially surrounded by a pair of substantially semicircular deflection electrodes disposed symmetrically about said central axis of said each of said apertures.

8. The printhead structure as defined in claim 1, in which each aperture has a substantially circular section having a central axis extending through the substrate layer, the periphery of each aperture being at least partially surrounded by a substantially ring-shaped print electrode disposed symmetrically about said central axis of each aperture.

9. The printhead structure as defined in claim 1, in which the first printed circuit comprises at least one guard layer of electrically conducting material having parts extending between the plurality of print electrodes to electrically shield the plurality of print electrodes from each other.

10. The printhead structure as defined in claim 1, in which said first and second printed circuits are at least partially coated by a protective layer of electrically insulating material.

11. The printhead structure as defined in claim 1, in which each aperture has an inner wall which is at least partially coated by a protective layer of electrically insulating material.

12. The printhead structure as defined in claim 1, in which the second printed circuit is at least partially coated by a protective layer of electrically insulating material overlaid with a layer of semiconductive material for removing excess electric charge from the vicinity of the apertures.

13. The method as defined in claim 2, in which the print sequence has at least two consecutive steps during each of which a predetermined relation between said first deflection voltage and said second deflection voltage influences the transport trajectory of the toner particle stream, each step corresponding thereby to an addressable dot location on the information carrier.

14. The method as defined in claim 2, in which the print sequence has at least two consecutive steps, during one of which said first deflection voltage is equal to said second deflection voltage and during another of said first deflection voltage is not equal to said second deflection voltage.

15. The method as defined in claim 2, in which the print sequence has at least two consecutive steps, during one of which said first deflection voltage is less than said second deflection voltage.

16. The method as defined in claim 2, in which the print sequence has at least three consecutive steps, during one of which said first deflection voltage is less than said second deflection voltage, during another of which said first deflection voltage is equal to said second deflection voltage, and during a third of which said first deflection voltage is greater than said second deflection voltage.

17. The method as defined in claim 2, in 2 which said first deflection voltage and said second deflection voltage are electric 3 potentials which produce electric forces which act to repel charged toner particles.

* * * * *

UNITED STATES PATENT AND TRADEMARK OFFICE

CERTIFICATE OF CORRECTION

PATENT NO. : 5,984,456
DATED : November 16, 1999
INVENTOR(S) : Bengt Bern

It is certified that error appears in the above-identified patent and that said Letters Patent is hereby corrected as shown below:

Claim 17,
Line 1, replace "in 2 which" with -- in which --.
Line 3, delete "3".

Signed and Sealed this

Fifth Day of February, 2002

*Attest:*

*Attesting Officer*

JAMES E. ROGAN
*Director of the United States Patent and Trademark Office*